US007766199B1

(12) United States Patent
Caperon

(10) Patent No.: US 7,766,199 B1
(45) Date of Patent: Aug. 3, 2010

(54) BABY CARRIER

(76) Inventor: Gabriela Caperon, 1733 Monrovia Ave., Unit N, Costa Mesa, CA (US) 92627

( * ) Notice: Subject to any disclaimer, the term of this patent is extended or adjusted under 35 U.S.C. 154(b) by 0 days.

(21) Appl. No.: 12/509,314

(22) Filed: Jul. 24, 2009

(51) Int. Cl.
*A61G 5/00* (2006.01)

(52) U.S. Cl. ..... 224/160; 224/159; 224/158

(58) Field of Classification Search ..... 224/160, 224/159, 158
See application file for complete search history.

(56) References Cited

U.S. PATENT DOCUMENTS

| | | | | | |
|---|---|---|---|---|---|
| D240,567 | S | * | 7/1976 | Tatum | D3/214 |
| D253,558 | S | * | 12/1979 | Carter | D3/214 |
| D255,180 | S | * | 6/1980 | Raz | D3/214 |
| 4,402,440 | A | | 9/1983 | Purtzer et al. | |
| 4,469,259 | A | * | 9/1984 | Krich et al. | 224/160 |
| D276,478 | S | * | 11/1984 | Fallon | D3/214 |
| 4,724,988 | A | * | 2/1988 | Tucker | 224/160 |
| 4,986,458 | A | | 1/1991 | Linday | |
| 5,205,451 | A | * | 4/1993 | Manzer | 224/161 |
| 5,246,152 | A | * | 9/1993 | Dotseth | 224/159 |
| D377,116 | S | * | 1/1997 | Shimura et al. | D3/214 |
| 5,673,828 | A | | 10/1997 | Raedel et al. | |
| D409,373 | S | * | 5/1999 | Fair et al. | D3/213 |
| 6,415,969 | B1 | * | 7/2002 | Higuchi | 224/160 |
| D484,685 | S | * | 1/2004 | Kassai et al. | D3/213 |
| D507,869 | S | * | 8/2005 | Liistro et al. | D3/214 |
| 2004/0245298 | A1 | * | 12/2004 | Refsum | 224/159 |
| 2005/0258202 | A1 | | 11/2005 | Stevens et al. | |
| 2008/0087694 | A1 | * | 4/2008 | Meng et al. | 224/160 |
| 2008/0283559 | A1 | | 11/2008 | Parness et al. | |

* cited by examiner

*Primary Examiner*—Nathan J Newhouse
*Assistant Examiner*—Lester L Vanterpool
(74) *Attorney, Agent, or Firm*—Christopher Wood; Daniel Eisenberg; Wood & Eisenberg, PLLC

(57) ABSTRACT

A baby carrier which is adjustable as to width at the hips of the baby. The baby carrier may comprise a body covering panel from which may project a right strap and a left strap for engaging the torso of an adult wearer. An arrangement of fasteners which may be located near the bottom edge of the body covering panel provides a selection of connections one of which will cause the body covering panel to form a first closed loop for encircling the baby at the hips, and another of which will cause the body covering panel to form a second closed loop for encircling the baby at the hips. The respective circumferential dimensions of the first closed loop and second closed loop are different, so as to accommodate different hip dimensions, for example for babies of different ages and body sizes.

16 Claims, 8 Drawing Sheets

| TABLE | |
|---|---|
| Part # | |
| A | shoulder |
| B | adult wearer |
| C | waist |
| D | body |
| 100 | baby carrier |
| 120 | body covering panel |
| 140 | top end |
| 160 | bottom end |
| 180 | right side |
| 200 | left side |
| 220 | central line of demarcation |
| 240 | lateral dimension |
| 260 | right upper strap |
| 280 | left upper strap |
| 300 | first strap fastener (right side) |
| 320 | first strap fastener (left side) |
| 340 | second strap fastener (right side) |
| 360 | second strap fastener (left side) |
| 380 | lateral strap |
| 400 | right central connector |
| 420 | left central connector |
| 440 | outer right side connector |
| 460 | outer left side connector |
| 480 | wide adjustment right side connector |

*FIG. 7A*

| | |
|---|---|
| 500 | wide adjustment left side connector |
| 520 | right section of lateral strap |
| 540 | right side lateral strap fastener |
| 560 | left section of lateral strap |
| 580 | left side lateral strap fastener |
| 600 | right projecting wing |
| 620 | left projecting wing |
| 640 | right upper strap proximal portion |
| 660 | right upper strap distal portion |
| 680 | left upper strap proximal portion |
| 700 | left upper strap distal portion |
| 720 | width of proximal portion 640 |
| 740 | width of distal portion 660 |
| 760 | central wide portion |
| 780 | broken line, Fig. 3 |
| 800 | first leg opening |
| 820 | second leg opening |
| 840 | crotch support |
| 860 | loop |

*FIG. 7B*

BABY CARRIER

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention relates to apparatuses for supporting and carrying a baby, including infants and toddlers. More particularly, this invention is directed to an apparatus including a flexible carrier adapted to be supported at the shoulders and hips of a person carrying the baby.

BACKGROUND OF THE INVENTION

A soft structured baby carrier as in the present invention is conventionally used for carrying a small child ranging from newborn to toddler, and weighing from seven to thirty-five pounds, against the torso of an adult, for example in the manner of a backpack type carrier. The baby carrier is placed on the adult's body and then the baby is placed inside the baby carrier. The baby carrier is intended to conform to natural body movements and posture of the adult, so that the load is evenly distributed over the adult's body. An important factor is that the baby be held in positions which are healthy for spinal and hip socket development.

Another problem is that of adjustability in adapting to the size of the baby. Newborns are much smaller than babies half a year older, for example, and babies of half a year are in turn smaller than toddlers.

There exists a need for a baby carrier which adapts to the size of the baby and which properly supports the body of the baby.

SUMMARY OF THE INVENTION

The present invention addresses the need for adapting to the size of the baby and which properly supports the body of the baby. In one aspect of the present invention, there is presented a baby carrier which can adjust for girth or size of a baby. This is accomplished by providing a scheme providing several connection options near the hips of the baby.

Notably, a system of fasteners enables the overall diameter of the envelope which encloses the baby at the hips to be relatively large or relatively small. Once an appropriate diameter is selected, the baby will be properly supported. Also, the weight of the baby will be advantageously distributed over the wearer's body.

This may be accomplished by a system of snaps for example, wherein selection of certain snaps results in a first circumferential dimension at the hips, and a different selection of snaps results in a different circumferential dimension at the hips. The selection providing the smaller circumferential dimension may establish a crotch support so that very small infants will not drop through the bottom of the novel baby carrier when worn by an adult. Adjustment to the larger circumferential dimension will not present the problem of the child falling through the bottom when the novel baby carrier is properly fixed to the adult wearer.

The novel baby carrier promotes a spread leg position of the child being carried. It also precludes uncomfortable and potentially injurious effects such as imposing tightness against the body of the baby in locations that might lead to constriction of the blood supply to the body of the baby.

BRIEF DESCRIPTION OF THE DRAWINGS

FIGS. 7A and 7B show a table of reference numerals utilized in this applications, together with the subject matter to which they refer.

Similar reference characters denote corresponding features consistently throughout the attached drawings.

DETAILED DESCRIPTION OF THE PREFERRED EMBODIMENTS

The present invention is directed to a baby carrier of the type which is worn at the torso of a person wanting to bring a baby with her or him. More specifically, the present invention is directed to a baby carrier that provides adjustment of width of envelopment of the hips of the baby.

Figure 1:
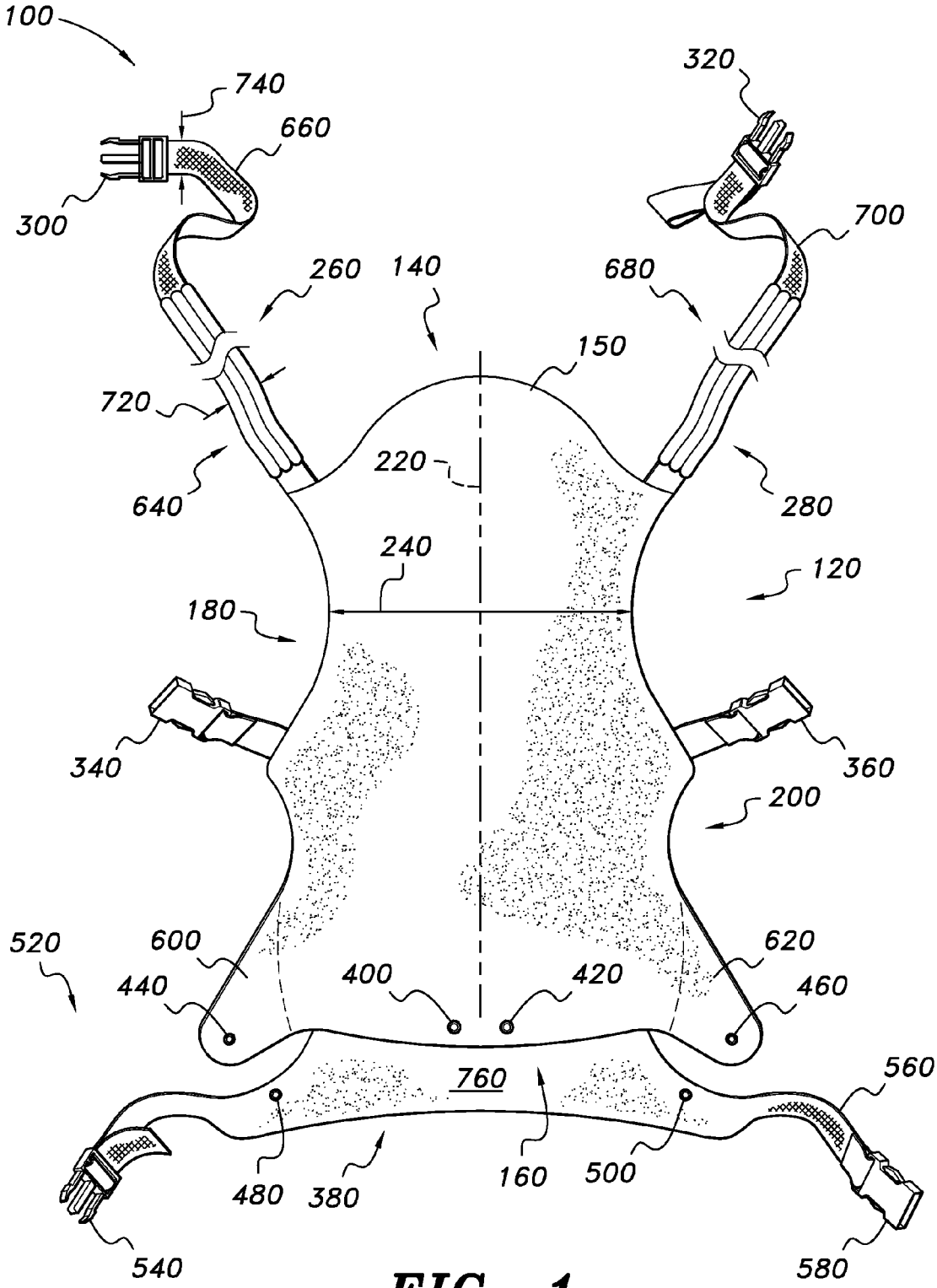
FIG. 1 is a plan view of a baby carrier according to at least one aspect of the invention, shown as it would be if spread out on a flat surface.
Figure 4:
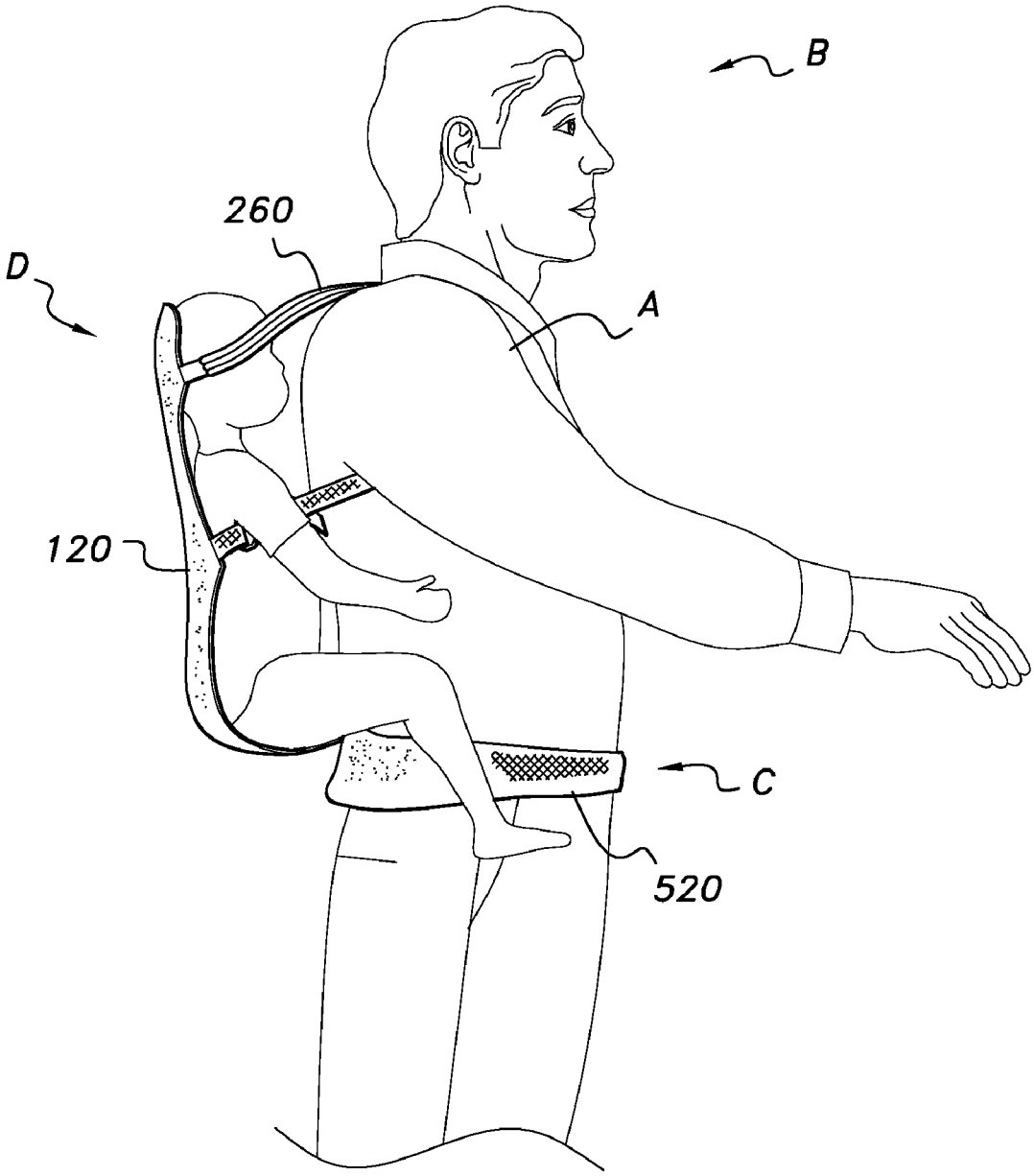
FIG. 4 is a side elevational environmental view of the baby carrier of FIG. 1.

Referring first to FIG. 1, a baby carrier 100 according to at least one aspect of the invention is shown in a condition it would assume if it were spread out on a flat surface. The baby carrier 100 is seen to comprise a body covering panel 120 comprising a top end 140 and a bottom end 160, and a right side 180 and a left side 200. The orientational terms "top", "bottom", "right", and "left" will be understood to apply when the baby carrier 100 and the body covering panel 120 are in a deployed position, i.e., when a baby is placed in the baby carrier 100 and the baby carrier 100 is worn by an adult user or wearer of the baby carrier 100, as shown in FIG. 4. Of course, use of the baby carrier 100 is not limited to adults. The term "adult" is used for semantic purposes in distinguishing between the baby and that person who will be carrying the baby about. In FIG. 1, the baby carrier 100 is viewed from the direction of the adult depicted in FIG. 4, so that elements located on the right side of the depiction are on the left side of the baby carrier 100, and vice versa. In the deployed position of FIG. 4, the baby is in the upright position, with the back of the baby abutting the baby carrier 100. It is possible to relocate the baby carrier 100 on the adult wearer so that the baby faces backwardly, from the perspective of the adult wearer. It is further possible to locate the baby carrier 100 such that the baby is located on the adult wearer's right side, left side, or front. However, for semantic convenience in describing the baby carrier 100, "deployed position" will refer to the position shown in FIG. 4.

The body covering panel 120 also has a right side 180 and a left side 200, which right side 180 and left side 200 extend from the top end 140 to the bottom end 160. A centrally located central line 220 of demarcation extends from the top end 140 to the bottom end 160, located equidistantly from the right side 180 and the left side 200. The body covering panel 120 may be dimensioned such that the right side 180 is spaced apart from the left side 200 by a lateral dimension indicated by the line 240 which is long enough to span the width of the body of a baby. Similarly, the top end 140 may be spaced apart from the bottom end 160 by a height dimension which is long enough to span the length or height of a baby. Height and width dimensions do not necessarily imply straight linear borders of the body covering panel. For example, the body covering panel 120 may define a convex upwardly projecting extension 150 located above at least one upper strap (to be described immediately hereafter) when the body covering panel 120 is in the deployed position.

Two upper straps including a right upper strap 260 and a left upper strap 280 may project from the top end 140 from spaced apart points along the top end 140, for encircling the body of the wearer. The upper straps 260 and 280 may each comprise respective first strap fasteners such as a right side upper strap fastener 300 and a left side upper strap fastener 320.

Corresponding second strap fasteners comprising a right side second strap fastener 340 and a left side second strap fastener 360 may be fixed to the body covering panel 120 respectively at the right side 180 and the left side 200 at a location between the top end 140 and the bottom end 160.

The strap fasteners 300, 320, 340, 360 may comprise paired pronged snap action fasteners and complementing sockets, such as those depicted in FIG. 1. Such fasteners are readily released by pinching the outer prongs inwardly when the fasteners are joined. The outer prongs are resiliently mounted, and bend readily in response to finger pressure, thereby removing the interference to withdrawal which occurs in the unpinched condition, and can be withdrawn from their corresponding sockets. These fasteners are of well known type and need not be further detailed herein.

The polarity and nature of the fasteners 300, 320, 340, 360 is such that each one of the first strap fasteners 300, 320 may be matingly compatible, or releasably engageable, with both of the second strap fasteners 340, 360.

A lateral strap 380 may be connected to the body covering panel 120 at the bottom end 160 and may project laterally therefrom when the body covering panel 120 is in the deployed position. The lateral strap 380 may extend along the bottom end 160 of the body covering panel 120 and may be configured to comprise a right section 520 projecting to the right of the body panel 120 and terminating in the right side lateral strap fastener 340, and a left section 560 projecting to the left of the body covering panel 120 and terminating in a left side lateral strap fastener 580 which is matingly engageable with the right side lateral strap fastener 540.

The baby carrier 100 may comprise a connector arrangement for adjusting the width of envelopment of the hips of the baby by the body covering panel 120. The connector arrangement may be located proximate the lateral strap 380 and may comprise a right central connector 400 located proximate and to the right of the central line of demarcation 220; a left central connector 420 located proximate and to the left of the central line of demarcation 220; an outer right side connector 440 located laterally spaced apart from and to the right of the right central connector 400, which outer right side connector 440 is matingly engageable with the right central connector 400; an outer left side connector 460 located laterally spaced apart from and to the left of the left central connector 420, which outer left side connector 460 may be matingly engageable with the left central connector 420; a wide adjustment right side connector 480 located laterally spaced apart from and to the right of the right central connector 400 and vertically displaced therefrom with respect to the central line of demarcation 220. The wide adjustment right side connector 480 may be matingly engageable with the outer right side connector 440, and a wide adjustment left side connector 500 located laterally spaced apart from and to the left of the left central connector 420 and vertically displaced therefrom with respect to the central line of demarcation 220.

More specifically, as depicted in FIG. 1, the right central connector 400, the left central connector 420, the outer right side connector 440, and the outer left side connector 460 may be disposed linearly along the bottom end 160 of the body covering panel 120, while the wide adjustment right side connector 480 and the wide adjustment left side connector 500 may be disposed on the lateral strap 380.

The wide adjustment left side connector 500 may be matingly engageable with the outer left side connector 460. As a consequence of this arrangement, and notably of the locations and engagement compatibility specified herein, it follows that engagement of the right central connector 400 with the outer right side connector 440, and of the left central connector 420 with the outer left side connector 460 establishes an enclosed girth of the body covering panel 120 of a first circumferential dimension at the bottom end 160 thereof. This first of two connection configurations would be appropriate for a newborn, or for any baby with minimal hip dimensions.

Along similar lines, engagement of the outer right side connector 440 with the wide adjustment right side connector 480, and of the outer left side connector 460 with the wide adjustment left side connector 500 establishes an enclosed girth of the body covering panel 120 of a second circumferential dimension at the bottom end 160 thereof. The second circumferential dimension is of course greater in magnitude than that of the first circumferential dimension, so that the second of the two connection configurations would be appropriate for a child older than a newborn, or for any child with hip dimensions greater than that of the newborn.

The right central connector 400, the left central connector 420, the outer right side connector 440, the outer left side connector 460, the wide adjustment right side connector 480, and the wide adjustment left side connector 500 may be snap fitting two part male and female fasteners of a well known type popularly called snaps, for example.

The connection for the first circumferential dimension may facilitated by configuration of the body covering panel 120. More specifically the body covering panel 120 may comprise a right projecting wing 600 and a left projecting wing 620. The outer right side connector 440 may be disposed on the right projecting wing 600. The outer left side connector 460 may be disposed on the left projecting wing 620.

The upper straps 160 and 280 may encircle the shoulders or torso of the adult wearer. The lateral strap 380 may encircle the waist of the adult wearer, for example as seen in FIG. 4. With encirclement of the shoulders or torso, and of the waist, the baby carrier 100 may be secured on the body of the adult wearer.

Continuing to refer to FIG. 1, the following component parts of the baby carrier 100 may be configured to improve overall weight distribution and comfort. Firstly, the body covering panel 120 may be of a flexible material such as a fabric, and may be padded along the entirety thereof. Secondly, either or both of the right upper strap 260, the left upper strap 280, and the lateral strap 380 each may be padded at least partially along their respective lengths. Padding may comprise cotton or other fiber batting, loose fiber fill, open cell or closed cell synthetic foams, and any combination of these.

The right upper strap 260 may comprise a proximal portion 640 which is padded, and a distal portion 660 comprising a strap which extends between the proximal portion 640 and the right side upper strap fastener 300. Similarly, the left upper strap 280 may comprise a proximal portion 680 which is padded, and a distal portion 700 comprising a strap which extends between the proximal portion 680 and the left side upper strap fastener 320.

The right upper strap proximal portion 640 has a width which is indicated between the two opposed arrows at 720. The right upper strap distal portion 660 has a width 740 which is indicated between the two arrows at 740. The width 740 may be less in magnitude than that of the width 720.

The left upper strap 280 may repeat the construction of the right upper strap 260, such that the proximal portion 680 may be padded and may be of width greater than that of the distal portion 700, the latter comprising an unpadded strap.

The lateral strap 380 may similarly be at least partially padded, and may comprise a central wide portion 760 which is fixed to the body covering panel 120, and from which extend the lateral strap right section 520 which terminates in the right side lateral strap fastener 540, and the lateral strap left section 560 which terminates in the left side lateral strap fastener 580. The lateral strap right section 520 and the lateral strap left section 560 may be of width which is narrower than the width of the central wide portion 760.

Padding of any of the components of the baby carrier 100 both increases comfort and facilitates favorable weight distribution over the adult wearer's body. It is contemplated that the areas shown herein to be padded are those areas for which padding is the most critical and advantageous. Hence it stands to reason that the same areas, at least for the right upper strap 260, the left upper strap 280, and the lateral strap 380 would be both wider and also padded.

Figure 2:
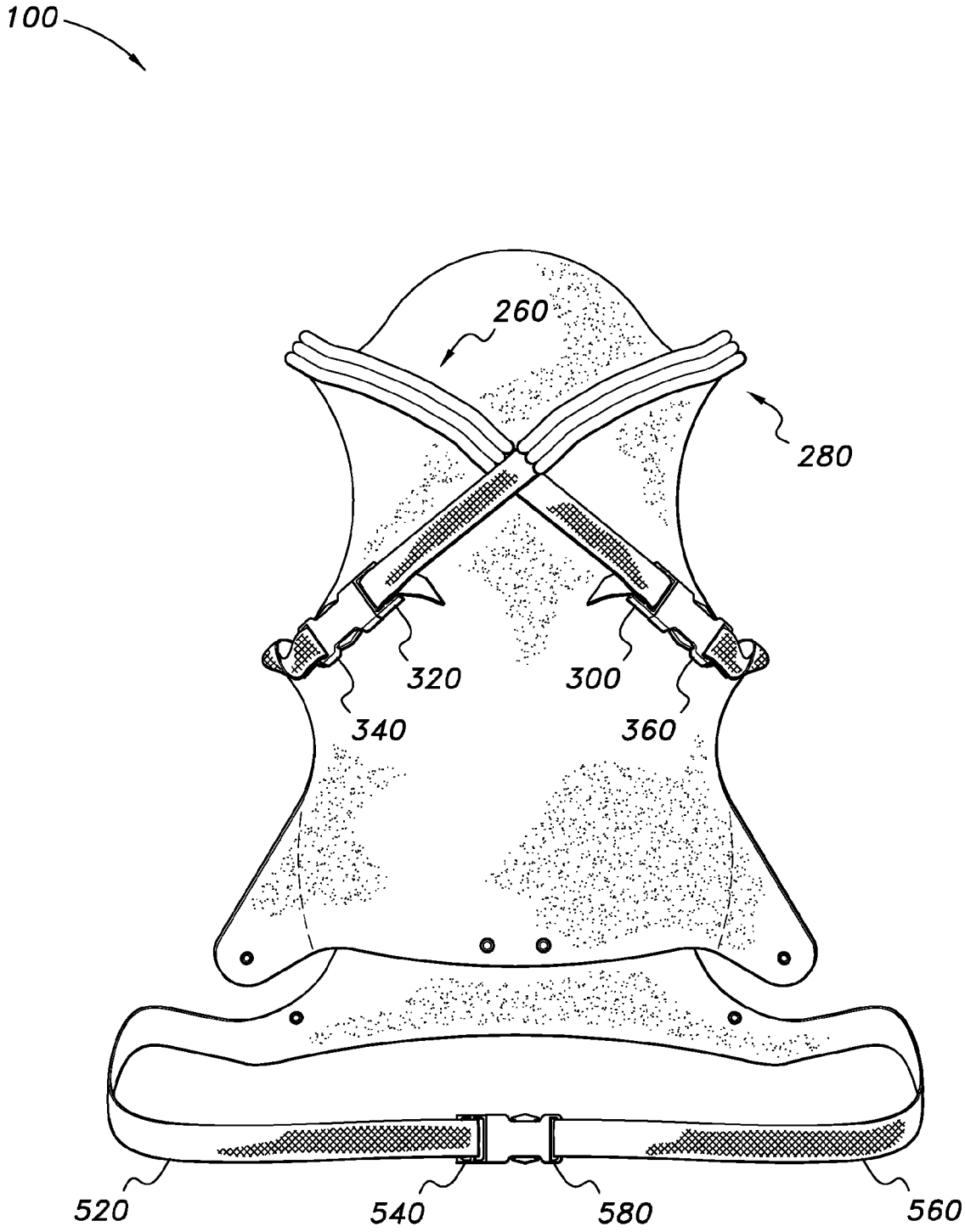
FIG. 2 is similar to FIG. 1, but shows the baby carrier as it would be if fastened to engage a user's body in one of several possible engagements.

FIG. 2 shows the baby carrier 100 in a condition reflecting one possible engagement of the wearer's body, but not showing connection for engaging the hips of a baby. In the condition depicted in FIG. 2, the right side first strap fastener 300 of the right upper strap 260 is engaged with the left side second strap fastener 360. Similarly, the left side first strap fastener 320 of the left upper strap 280 is engaged with the right side second strap fastener 340. In this condition, the right upper strap 260 crosses the left upper strap 280.

Figure 3:
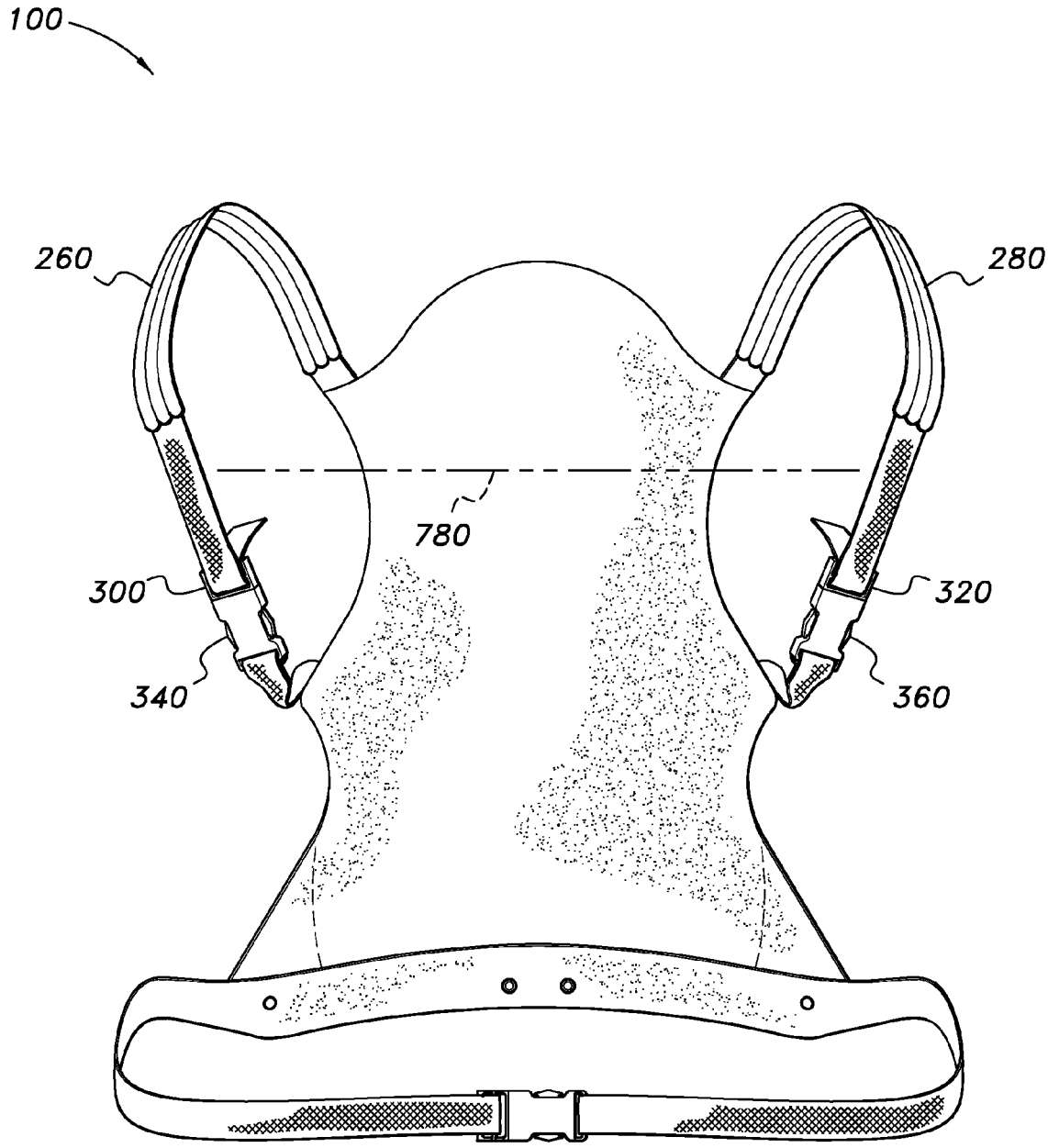
FIG. 3 is similar to FIG. 1, but shows the baby carrier in another one of several possible engagements of a user's body.

Referring now to FIG. 3, it would be possible to connect the right upper strap 260 to the right side second strap fastener 340 and to connect the left upper strap 280 to the left side second strap fastener 360 so that the right upper strap 260 and the left upper strap 280 do not cross. It would be possible to provide a strap or equivalent member (not shown per se, but represented as a broken line 780) either integrally with the baby carrier 100 or as a separate component to keep the right upper strap 260 and the left upper strap 280 from spreading apart.

FIG. 4 shows the baby carrier 100 as it would be in one possible usage. In the condition of FIG. 4, the right upper strap 260 is seen to encircle the shoulder A of the adult wearer B. The lateral strap 380 (see FIG. 1) is seen to encircle the waist C of the adult wearer B. The lateral strap 380 is tightly adjusted about the waist C of the adult wearer B. This eliminates any downwardly accessible openings which might otherwise enable the baby D to fall from the baby carrier 100.

Figure 5:
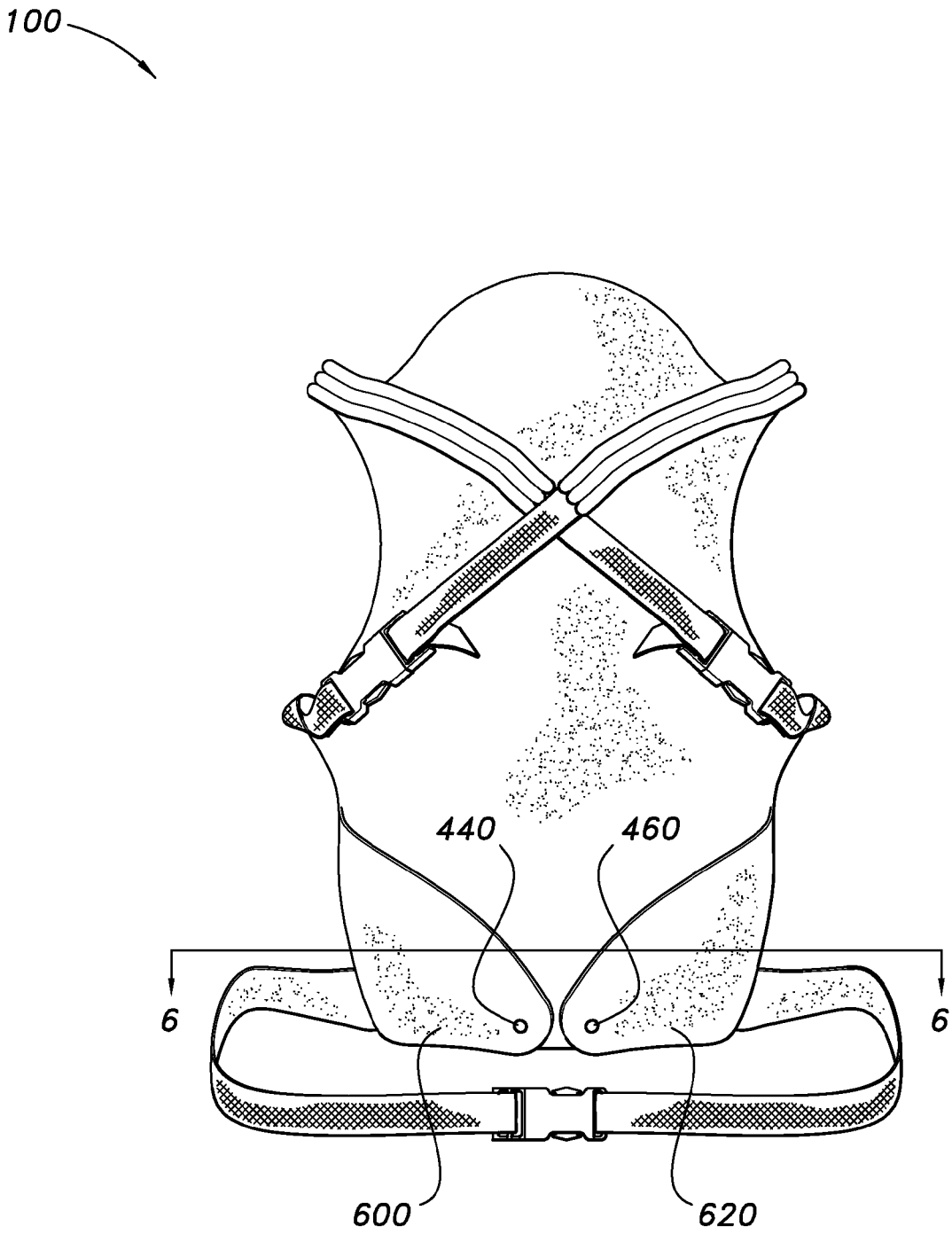
FIG. 5 is a front elevational view of the baby carrier of FIG. 1, showing engagement of the use body as seen in FIG. 2, and also showing a form fitting adjustment appropriate for a newborn or other very small baby.
Figure 6:
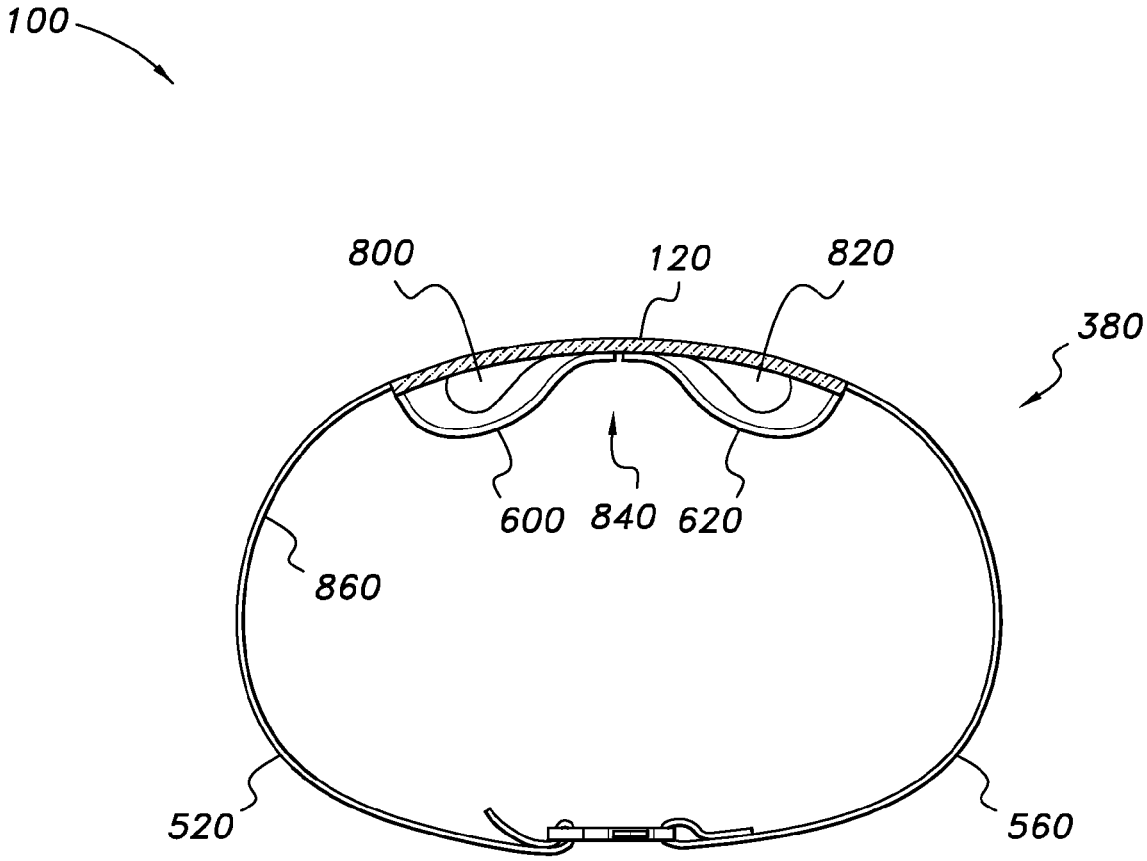
FIG. 6 is a top plan view taken along line 6-6 of FIG. 5.

Referring now to FIGS. 5 and 6, the baby carrier 100 is shown with the connection of FIG. 2 as to engagement of an adult wearer (e.g., the adult wearer B of FIG. 4), but with the connector arrangement for adjusting the width of envelopment of the hips of the baby (such as the baby D) adjusted to accommodate a baby of very small size. To the latter end, the outer right side connector 440 is engaged with the right central connector 400 (see FIG. 1), and the outer left side connector 460 is engaged with the left central connector 420 (see FIG. 1). The consequence of this connection is that a first leg opening 800 and a second leg opening 820 spaced apart laterally from the leg opening 800 are generated. The ends of the right projecting wing 600 and the left projecting wing 620 and their respective connectors 440 and 460, together with the right central connector 400 and the left central connector 420, all combine to establish an interference serving as a crotch support proximate the bottom end 160 of the body covering panel 120. This crotch support, indicated generally at 840, opposes downward movement of even a very small baby through the interior of a loop 860 formed collectively by the body covering panel 120 and the lateral strap 380.

The present invention is susceptible to variations and modifications which could be introduced thereto without departing from the inventive concept. For example, it would be possible to provide only one upper strap (not shown) to perform the function of one or both of the upper straps 260, 280. For example, one such strap (not shown) could attach to the body covering panel 120 at an initial point, for example, at one point along the length of the top end 140, connect to the body covering panel 120 at a lower point on the body covering panel 120, and turn to extend upwardly and connect to the top end 140 at a location spaced apart from the initial point. Such a single strap could form a V for example, and replace the right and left upper straps 260, 280.

The lateral strap 380 could be eliminated in favor of retaining functional equivalents (not shown) of the lateral strap right section 520 and the lateral strap left section 560. Illustratively, functional equivalents of the lateral strap right section 520 and the lateral strap left section 560 could originate at and project from the body covering panel 120. Alternatively, a separate belt (not shown) could be provided for encircling the waist of the adult wearer while performing the functions detailed herein.

The connector arrangement for adjusting the width of envelopment of the hips of the baby by the body covering panel 120 may be varied in its nature. The number of connectors and the resultant number of girth adjustments may be increased beyond the two girth adjustments described and shown herein. Connectors of the connector arrangement may be varied in their nature, locations, and other characteristics.

Connectors and fasteners, where shown as being of the type enabling only one point of contact, may be changed to a type which permits more than one point of contact. For example, snaps, such as those utilized in the connector arrangement for adjusting the width of envelopment of the his of the baby, may be omitted in favor of hook and loop fastener, which is a fastener type which enables adjustability of the point of contact in nearly infinite increments. Similar substitutions may be made for other connectors and fasteners used herein.

It will also be appreciated that babies may be carried by the novel baby carrier such as the baby carrier 100 in more positions than just those illustrated herein. For example, the baby may be carried at the front of the adult, with the baby either facing forwardly or facing backwardly, with the straps 260 and 280 either crossed or extending generally parallel to one another. Also, the baby may be carried at the hip of the adult on either side. In addition, the baby may be carried at the back of the adult, facing forwardly.

It is to be understood that the present invention is not limited to the embodiments described above, but encompasses any and all embodiments within the scope of the following claims.

I claim:

1. A baby carrier for carrying a baby at the torso of a person wearing said baby carrier, wherein said baby carrier provides adjustment of width of envelopment of the hips of the baby, said baby carrier comprising:

a body covering panel comprising a top end and a bottom end when said body covering panel is in a deployed position wherein said body covering panel abuts a child held upright therein, a right side extending between said top end and said bottom end, a left side extending between said top end and said bottom end, and a central line of demarcation extending from said top end to said bottom end and being equidistantly located from said right side and said left side, said right side being spaced apart from said left side by a lateral dimension which is long enough to span the width of the body of a baby, said top end being spaced apart from said bottom end by a height dimension which is great enough to span the length of a baby;

at least one upper strap projecting from said top end at one point along the length of said top end, for encircling the body of the wearer, said upper strap having a first strap fastener;

a second strap fastener fixed to said body covering panel at one of said right side and said left side of said body covering panel at a location between said top end and said bottom end, wherein said second strap fastener is releasably engageable with said first strap fastener of said upper strap;

a lateral strap connected to said body covering panel at said bottom end thereof and projecting laterally therefrom when said body covering panel is in the deployed position; and a connector arrangement for adjusting the width of envelopment of the hips of the baby by said body covering panel, the connector arrangement being located proximate said lateral strap and comprising a right central connector located proximate and to the right of said central line of demarcation and a left central connector B located proximate and to the left of said central line of demarcation, an outer right side connector located laterally spaced apart from and to the right of said right central connector, which said outer right side connector is matingly engageable with said right central connector, an outer left side connector located laterally spaced apart from and to the left of said left central connector, which said outer left side connector is matingly engageable with said left central connector, a wide adjustment right side connector located laterally spaced apart from and to the right of said right central connector and vertically displaced therefrom with respect to said central line of demarcation, which said wide adjustment right, side connector is matingly engageable with said outer right side connector, and a wide adjustment left side connector located laterally spaced apart from and to the left of said left central connector and vertically displaced therefrom with respect to said central line of demarcation, which said wide adjustment left side connector is matingly engageable with said outer left side connector, whereby engagement of said right central connector with said outer right side connector, and of said left central connector with said outer left side connector establishes an enclosed girth of a first circumferential dimension at said bottom end of said central panel, and engagement of said outer right side connector with said wide adjustment right side connector, and of said outer left side connector with said wide adjustment left side connector establishes an enclosed girth of a second circumferential dimension at said bottom end of said central panel, wherein said second circumferential dimension is greater in magnitude than that of said first circumferential dimension.

2. The baby carrier of claim 1, wherein said lateral strap extends along said bottom end of said body covering panel and comprises a right section projecting to the right of said body covering panel and terminating in a right side lateral strap fastener, and a left section projecting to the left of said body covering panel and terminating in a left side lateral strap fastener which is matingly engageable with said right side lateral strap fastener.

3. The baby carrier of claim 1, wherein said at least one upper strap comprises a right side upper strap projecting from said right side of said body covering panel and comprising a right side upper strap fastener, and a left side upper strap projecting from said left side of said body covering panel and comprising a left side upper strap fastener, and said second strap fastener comprises a right side second strap fastener fixed to said right some of said body covering panel and a left side second strap fastener fixed to said left side of said body covering panel, wherein said right side upper strap fastener and said left side per strap fastener are each matingly compatible with both of said right side second strap fastener and said left side second strap fastener.

4. The baby carrier of claim 3, wherein said right side strap fastener, said left side strap fastener, said right side upper strap fastener, and said left side upper strap fastener comprise paired pronged snap action fasteners and complementing sockets.

5. The baby carrier of claim 3, wherein said right side upper strap comprises a proximal portion which is padded, and said left side upper strap comprises a proximal portion which is padded.

6. The baby carrier of claim 3, wherein said right side upper strap comprises a proximal portion which has a width, and a distal portion extending between said proximal portion and said right first strap fastener and has a width less in magnitude than that of said proximal portion, and said left side upper strap comprises a proximal portion which has a width, and a distal portion extending between said proximal portion and said left first strap fastener and has a width less in magnitude less than that of said proximal portion.

7. The baby carrier of claim 1, wherein said body covering panel comprises a right projecting wing and a left projecting wing, and said outer right side connector is disposed on said right projecting wing, and said outer left side connector is disposed on said left projecting wing.

8. The baby carrier of claim 1, wherein said body covering panel is padded along the entirety thereof.

9. The baby carrier of claim 1, wherein said body covering panel defines a convex upwardly projecting extension located above said at least one upper strap when said body covering panel is in the deployed position.

10. The baby carrier of claim 1, wherein said at least one upper strap is padded at least partially along its length.

11. The baby carrier of claim 1, wherein said lateral strap is padded at least partially along its length.

12. The baby carrier of claim 1, wherein said right central connector, said left central connector, said outer right side connector, said outer left side connector, said wide adjustment right side connector, and said wide adjustment left side connector are all snap fitting fasteners.

13. The baby carrier of claim 1, wherein said right central connector, said left central connector, said outer right side connector, and said outer left side connector are disposed linearly along said bottom end of said body covering panel.

14. The baby carrier of claim 13, wherein said wide adjustment right side connector and said wide adjustment left side connector are disposed on said lateral strap.

15. The baby carrier of claim 1, wherein said lateral strap comprises a central wide portion fixed to said body covering panel, a lateral strap right section and a lateral strap left section, and said lateral strap right section and said lateral strap left section are of width which is narrower than that of the central wide portion.

16. The baby carrier of claim 1, wherein said connector arrangement is disposed to generate a first leg opening along said bottom end and a second leg opening along said bottom end, wherein said second leg opening is spaced apart laterally from said first leg opening, thereby establishing a crotch support proximate said bottom end.

* * * * *